US006048243A

United States Patent [19]

Kosaka et al.

[11] Patent Number: 6,048,243

[45] Date of Patent: Apr. 11, 2000

[54] METHOD OF FORMING BARRIER RIBS OF DISPLAY PANEL

[75] Inventors: Tadayoshi Kosaka; Fumihiro Namiki; Osamu Toyoda; Keiichi Betsui; Akira Tokai, all of Kanagawa, Japan

[73] Assignee: Fujitsu Limited, Kawasaki, Japan

[21] Appl. No.: 08/791,771

[22] Filed: Jan. 29, 1997

[30] Foreign Application Priority Data

Apr. 22, 1996 [JP] Japan ..... 8-099941

[51] Int. Cl.[7] ..... H01J 9/00

[52] U.S. Cl. ..... 445/24

[58] Field of Search ..... 445/24

[56] References Cited

U.S. PATENT DOCUMENTS 5,730,635 3/1998 De Haas et al. ..... 445/24

FOREIGN PATENT DOCUMENTS 06068801 3/1994 Japan .

06314542 11/1994 Japan .

07045194 2/1995 Japan .

745193 2/1995 Japan .

*Primary Examiner*—Kenneth J. Ramsey

*Attorney, Agent, or Firm*—Greer, Burns & Crain, Ltd.

[57] ABSTRACT

The present invention provides a method of forming a plurality of barrier ribs each having an elongate configuration in plan and extending in the same direction within a display area for fabrication of a display panel. The method comprises the steps of forming a mask for cutting, having a masking pattern corresponding to the plurality of barrier ribs on a rib material layer, and removing portions of the rib material layer by jetting a cutting medium thereto, wherein the masking pattern is configured such that a plurality of elongate portions corresponding to the respective barrier ribs each extend across the display area to the outside of the display area and a spacing between adjacent end portions of elongate portions is smaller than a spacing between adjacent elongate portions within the display area.

8 Claims, 14 Drawing Sheets

61D

61E

METHOD OF FORMING BARRIER RIBS OF DISPLAY PANEL

BACKGROUND OF THE INVENTION

1. Field of the Invention

The present invention relates to a method of forming barrier ribs of a display panel, particularly a method of forming barrier ribs in a display area for fabrication of a display panel such as a plasma display panel (PDP).

2. Description of the Related Art

Thin display panels such as PDP, LCD and FED are used in various fields. In particular, the PDP which exhibits an excellent visibility and a high display speed is suitable for high-definition display, for example, what is known as high-vision in JAPAN.

The PDP is a self-luminous display panel which has a discharge space defined by a pair of substrates (typically, glass plates) spaced a minute distance in an opposing relation with the periphery thereof being sealed.

In general, PDPs employing a matrix display system include barrier ribs having a height of about 100 $\mu$m to about 200 $\mu$m for partitioning the discharge space. For examnle, a PDP of a surface discharge type suitable for fluorescent color display includes linear barrier ribs equidistantly arranged across lines for matrix display. The spacing between adjacent barrier ribs (inter-rib spacing) is, for example, about 200 $\mu$m for a 21-inch color PDP. The barrier ribs prevent discharge coupling and color cross-talk between adjacent cells.

In recent years, a dry etching technique has been replaced with a pattern printing technique for the formation of the barrier ribs. Exemplary dry etching processes hitherto known include a sand blast method and a hydro-honing method. In the sand blast method, a uniform rib material layer (plain film) is formed on a substrate and then a cutting mask having a predetermined pattern is formed thereon by photolithography. Thereafter, the rib material layer is patterned by jetting thereto particles as a cutting medium. In the hydro-honing method, a liquid as a cutting medium is jetted to the rib material layer for the patterning thereof. The sand blast method and the hydro-honing method are suitable for the formation of barrier ribs in a large display screen in terms of productivity, and exhibit a higher patterning accuracy than a wet etching method. In particular, the sand blast method is often employed because of its convenience.

In a conventional practice, the cutting mask pattern has substantially the same configuration as that of a rib pattern, except that a predetermined margin is added to the dimensions of the rib pattern in consideration of the contraction of the rib material during annealing after the removal of the rib material layer. That is, the cutting mask has a configuration similar (or conformable) to that of the rib pattern as viewed in plan.

An attempt has been made to form barrier ribs having reduced dimensions for higher definition by using such a cutting mask. Where the inter-rib spacing is reduced to the extent of about 100 $\mu$m, however, an inconvenience often occurs such that the barrier ribs are partially lost during the sand blast process. That is, the incidence of patterning defect is drastically increased.

One method for preventing such a patterning defect is as follows. A protecting mask is provided on outer periphery of ends of the cutting mask to block an air flow along the length the barrier ribs during the rib-material cutting process, thereby preventing excessive removal of end portions of the barrier ribs (see Japanese Unexamined Patent Publication No. HEI 7(1995)-45193). However, a proper dimensional control of the protection mask is difficult where unnecessary rib portions should not exist around intended barrier ribs in a display panel. In the PDP, for example, the unnecessary rib portions obstruct an evacuating process and, therefore, the protection mask should be so designed that the unnecessary rib portions below the protection mask can be completely removed at the end of the rib-material cutting process. In addition, this method is not effective for prevention of the widthwise side-cut of the barrier ribs, so that the patterning defect cannot be perfectly prevented.

SUMMARY OF THE INVENTION

In accordance with the present invention, there is provided a method of forming a plurality of barrier ribs each having an elongate configuration in plan and extending in the same direction within a display area for fabrication of a display panel, comprising the steps of: forming a mask for cutting having a masking pattern corresponding to the plurality of barrier ribs on a rib material layer; and removing portions of the rib material layer by jetting a cutting medium thereto, wherein the masking pattern is configured such that a plurality of elongate portions corresponding to the respective barrier ribs each extend across the display area to the outside of the display area and a spacing between adjacent end portions of elongate portions is smaller than a spacing between adjacent elongate portions within the display area.

The present invention prevents the patterning defect, which may otherwise be entailed by the size reduction of the barrier ribs, to increase the yield in fabrication of a high-definition display panel.

DESCRIPTION OF THE PREFERRED EMBODIMENTS

The inventors of the present invention investigated the cause of the patterning defect. As a result, it has been found that, in a patterning process such as a sand blast process in which a cutting medium is jetted against a rib material to be patterned, the cutting ratio is not directly proportional to the cutting surface area (area of a mask aperture) and, when the cutting surface area is reduced below a certain level, the cutting rate is drastically reduced.

Figure 14A:
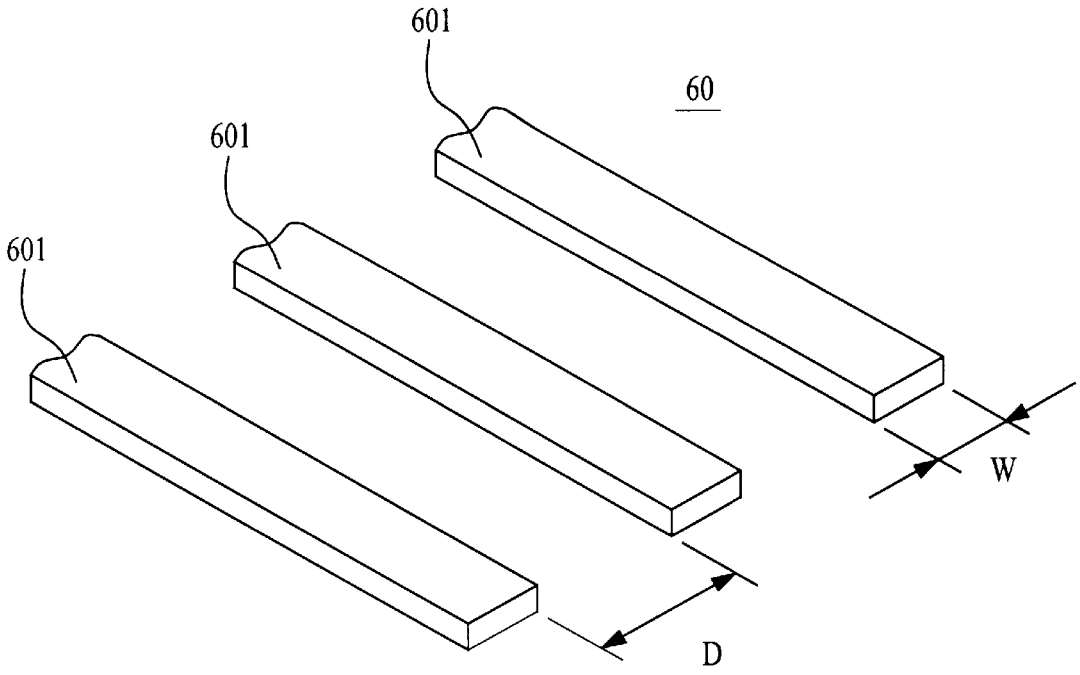
FIGS. 14A, 14B and 14C are explanatory diagrams for the definition of the inter-rib spacing and the side-cut amount.
Figure 14C:
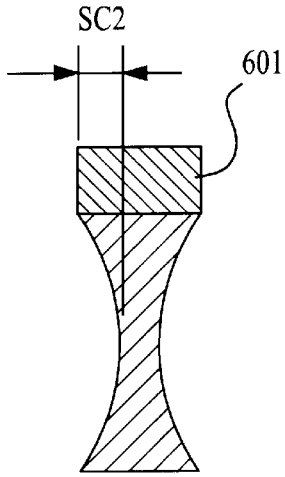
Figure 14B:
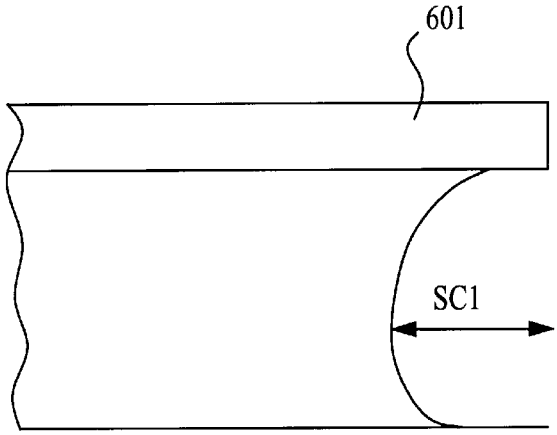
Figure 15:
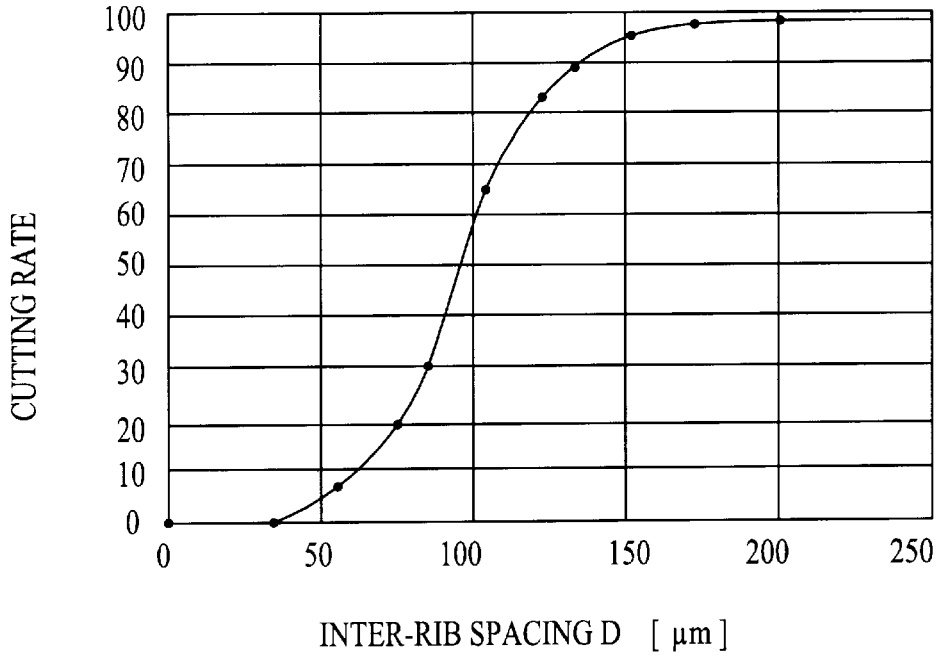
FIG. 15 is a graphical representation illustrating the relationship of the inter-rib spacing versus the cutting rate in the prior art.
Figure 16:
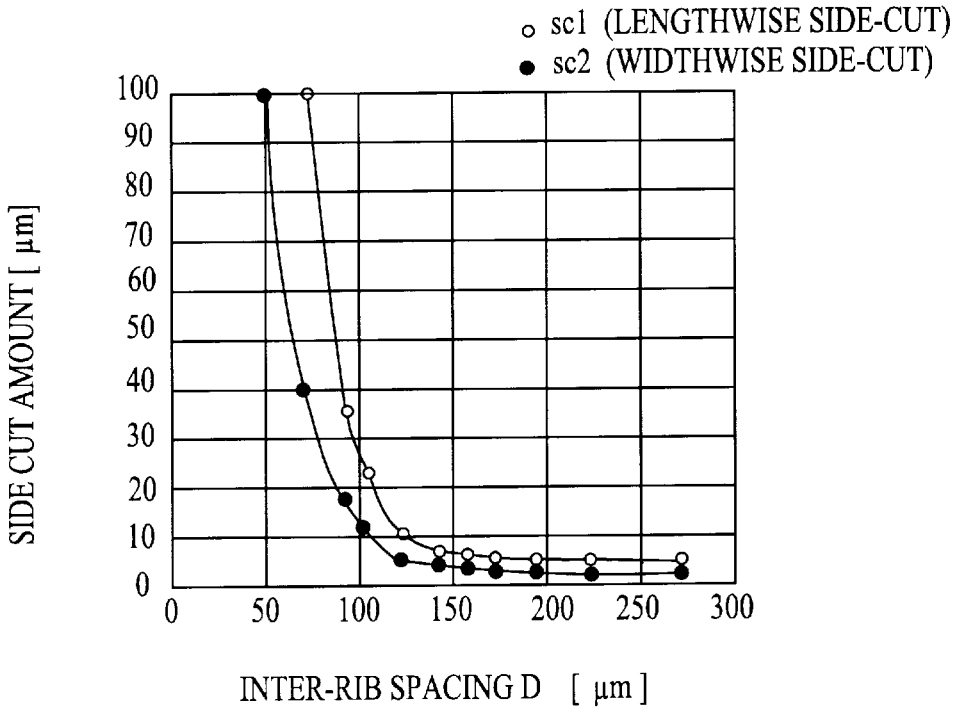
FIG. 16 is a graphical representation illustrating the relationship of the inter-rib spacing versus the side-cut amount in the prior art.

FIGS. 14A, 14B and 14C are explanatory diagrams for the definition of the inter-rib spacing and the side-cut amount. FIG. 15 is a graphical representation illustrating the relationship of the inter-rib spacing versus the cutting rate, and FIG. 16 is a graphical representation illustrating the relationship of the inter-rib spacing versus the side-cut amount. The relationships shown in FIGS. 15 and 16 were determined in the sand blast process (jetting pressure 2.0 kg weight/cm$^2$, mean diameter of sand particles: 30 $\mu$m). In FIG. 15, the cutting rate plotted as ordinate is represented on a relative scale regarding as 100 the cutting rate measured when the cutting was performed without masking.

The inter-rib spacing is herein defined as a width D of an aperture of the cutting mask 60 measured along arrangement of the barrier ribs to be formed. In the following description, the width of an elongate portion of the cutting mask 60 corresponding to one barrier rib is referred to as "rib width W" for convenience.

As shown in FIG. 15, where the inter-rib spacing D is not less than 150 $\mu$m, little difference is observed in the cutting rate in comparison with a case where the inter-rib spacing D is infinite. Where the inter-rib spacing is about 130 $\mu$m or less, however, the cutting rate is drastically reduced. This means that, if the inter-rib spacing is reduced, a large difference in the cutting rate will be made between the periphery of a rib formation region (where the inter-rib spacing D is virtually infinite) and the other areas. Although the measurements shown in FIG. 15 generally depend on the cutting conditions, a drastic drop in the cutting rate was observed regardless of the cutting conditions.

Further investigation of the patterning defect has taught as follows. During the operation for cutting the rib material to a depth required for the formation of the barrier ribs, the longitudinal side-cut amount scl of a barrier rib is increased, and the widthwise side-cut amount sc2 around an end portion thereof reaches the rib width W. Therefore, a significant portion of the cutting mask is suspended, so that the cutting mask is peeled off to cause the patterning defect.

In view of the foregoing, the inventors have found that the patterning defect can be prevented by employing a cutting mask having a reduced inter-rib spacing around ends of the barrier ribs to partially delay the cutting of the rib material.

It is an object of the present invention to prevent the patterning defect, which may otherwise be entailed by the size reduction of barrier ribs in a display panel, by employing a cutting mask having a reduced inter-rib spacing around ends of the barrier ribs to partially delay the cutting of a rib material layer, thereby increasing the yield in fabrication of a high-definition display panel.

The foregoing and the other objects, features and effects of the present invention will become apparent from the following description with reference to the attached drawings.

In the present invention, a glass substrate, a ceramic substrate and the like are usable as the substrate but, in terms of the ease of processing and planarization, it is preferred to use the glass substrate.

Usable as a rib material for the formation of the barrier ribs is a glass paste. In terms of the melting point, it is preferred to use a low-melting point glass paste.

The formation of the mask on the rib material layer is achieved by a known photolithography method using a photoresist of a known material.

Exemplary methods for jetting the cutting medium against the substrate include a sand blast method, a hydro-honing method and the like, but the sand blast method is preferred in terms of convenience.

Materials of cutting medium for the sand blast include particles of glass, aluminum oxide (alumina), silicon carbide, calcium carbonate and ice (water). Inorganic glass particles are typically used.

In the barrier rib formation method according to the present invention, the elongate portions of the masking pattern corresponding to the respective barrier ribs may each have an end portion laterally projecting with respect to the other portion thereof.

The masking pattern may be a stripe pattern having a plurality of elongate portions corresponding to the respective barrier ribs, and the elongate portions may each have an end portion having a greater width than the other portion thereof.

In the masking pattern which includes the elongate portions each having an end portion with a greater width than the other portion thereof, the end portions of the elongate portions may be arranged in a staggered manner.

The masking pattern may be a meander pattern having a plurality of elongate portions corresponding to the respective barrier ribs and arcuate portions each interconnecting ends of adjacent elongate portions.

In the present invention, elongate portions located on opposite sides of arrangement of the elongate portions may each have a greater width than the other elongate portions A display panel according to the present invention includes a plurality of barrier ribs each having an elongate configuration in plan and extending in the same direction within a display area, wherein a spacing between adjacent end portions of barrier ribs is smaller than a spacing between adjacent barrier ribs within the display area.

In the display panel according to the present invention, the barrier ribs may each have a plan configuration such that an end portion thereof laterally projects with respect to the other portion thereof.

A substrate structure according to the present invention which is employed as one component of a display panel includes: a substrate; and a plurality of elongate barrier ribs formed on the substrate by the aforesaid barrier rib formation method; the plurality of elongate barrier ribs extending parallel to each other to a region outside of a display-area formation region; wherein a spacing between adjacent barrier ribs in the outside region is smaller than a spacing between adjacent barrier ribs within the display-area formation region.

The present invention will hereinafter be described in detail by way of embodiments thereof illustrated in the attached drawings. It should be noted that the embodiments are not limitative of the present invention.

Figure 1A:
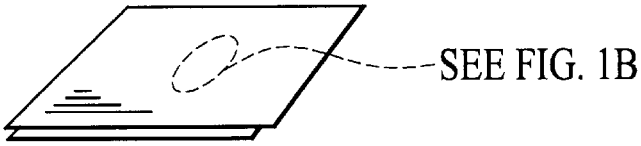
FIGS. 1A and 1B are a perspective views illustrating the internal construction of a PDP according to the present invention.
Figure 1B:
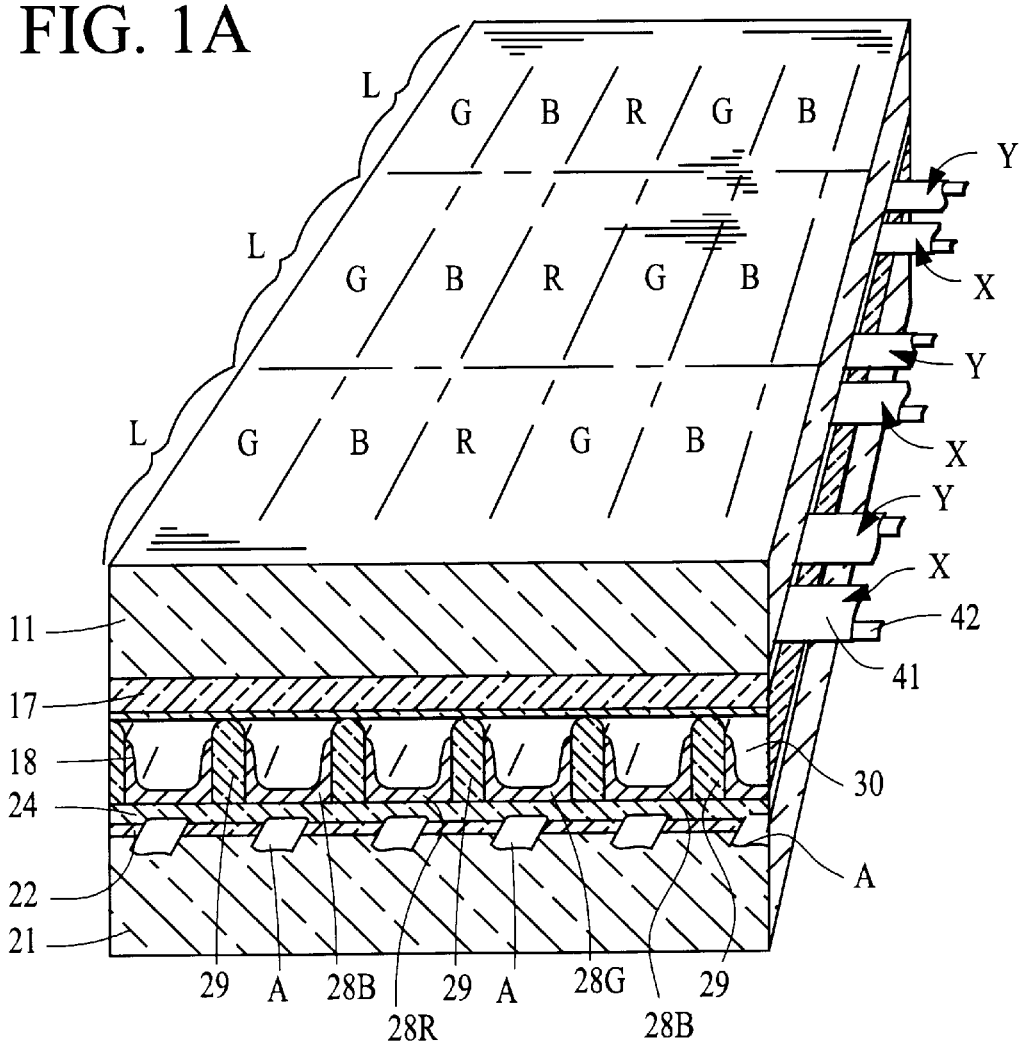
Figure 2:
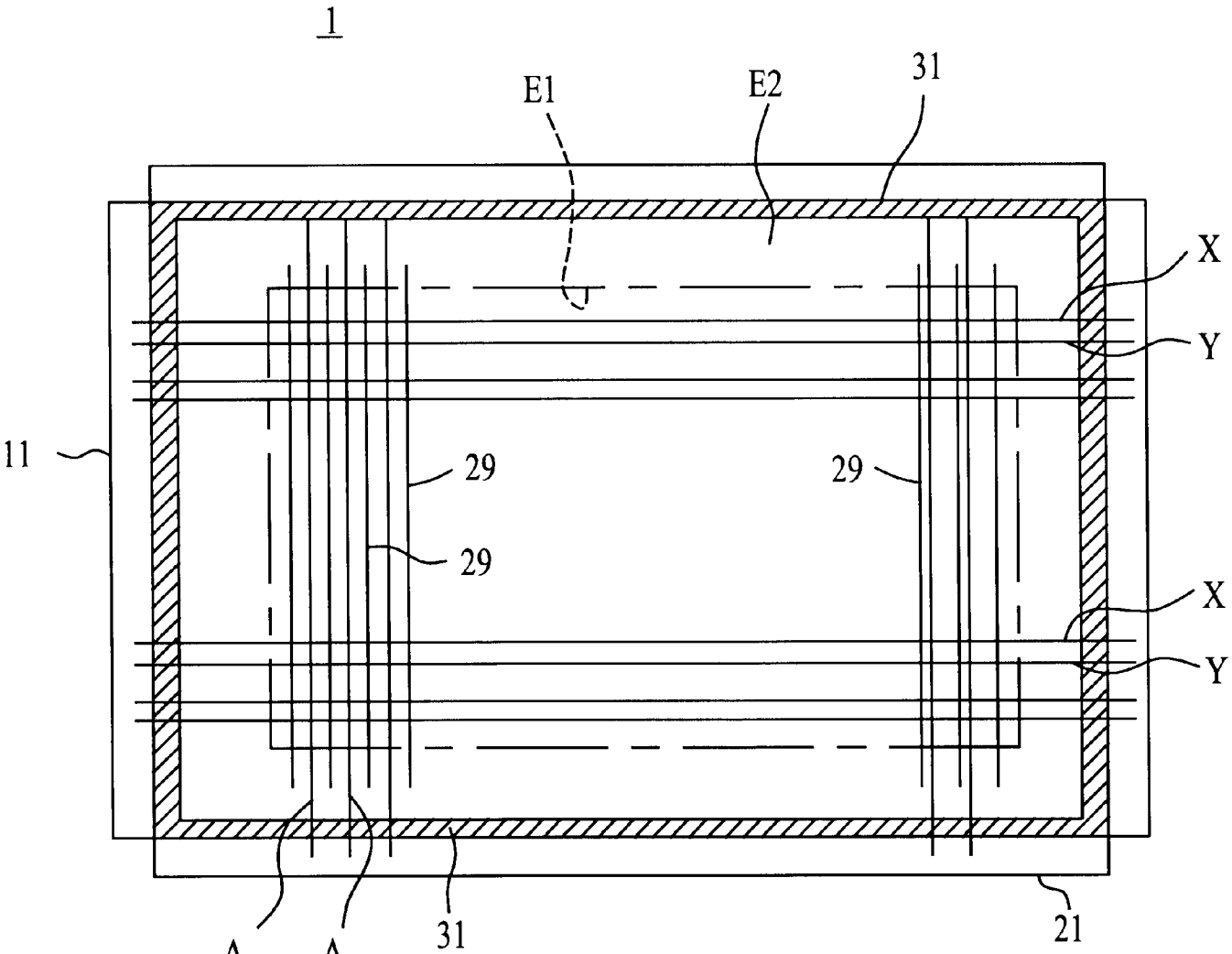
FIG. 2 is a plan view illustrating the arrangement pattern of barrier ribs of the PDP according to the present invention.

FIGS. 1A and 1B are perspective views illustrating the internal construction of a PDP 1 according to the present invention, and FIG. 2 is a plan view illustrating the arrangement pattern of barrier ribs of the PDP 1.

The PDP 1 is a AC-driven PDP of a surface discharge type. A pair of sustain electrodes X and Y for each line L for matrix display are disposed on an interior surface of a front glass substrate 11. The sustain electrodes X and Y each include a transparent electrode 41 and a metal electrode 42, and covered with a dielectric layer 17 for AC driving. A protection film 18 of MgO is formed on a surface of the dielectric layer 17 by vapor deposition.

Provided on an interior surface of a rear glass substrate 21 are a base layer 22, address electrodes A, an insulating layer 24, barrier ribs 29 and fluorescent layers of three colors (R, G, B) 28R, 28G and 28B. The barrier ribs 29 each have a macroscopically linear configuration in plan. The barrier ribs 29 partition a discharge space 30 on a row-by-row basis for the matrix display to define subpixels each having a predetermined size. One pixel (picture element) comprises three subpixels arranged along a line. In the PDP 1, the barrier ribs 29 are arranged in a so-called stripe pattern and, therefore, the subpixels in each row in the discharge space 30 are arranged in sequence across all the lines L. The subpixels in each row are adapted to emit the same fluorescent color.

As shown in FIG. 2, a region where the sustain electrodes X and Y cross the address electrodes A serves as matrix display area E1. A non-luminous area E2 having a width of several millimeters is provided between a frame sealer 31 for bonding the glass substrates 11 and 21 and the matrix display area E1. The barrier ribs 29 are disposed parallel to the address electrodes A, and extend slightly outside the matrix display area E1.

FIGS. 3A to 3D are diagrams for explaining a method of forming a substrate for a display panel having barrier ribs according to the present invention.

Figure 3A:
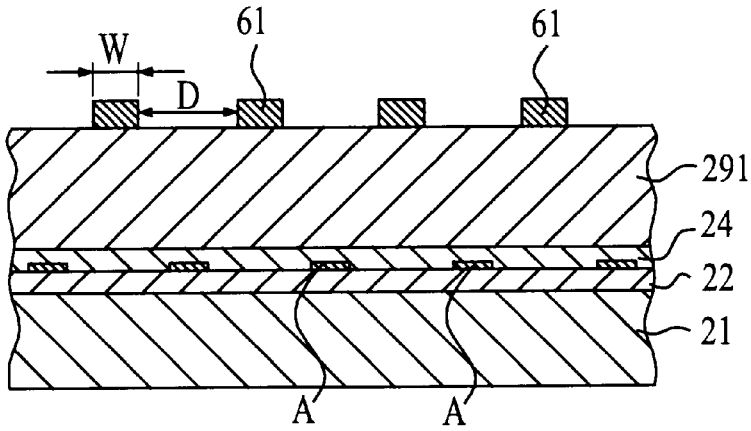
FIGS. 3A to 3D are diagrams for explaining a method of forming a substrate for a display panel having barrier ribs according to the present invention.

A low-melting-point glass paste is applied on 12 substantially the entire surface of the glass substrate 21 formed with the address electrodes A and covered with the insulating layer 24, and then dried to form a rib material layer 291 having a thickness of about 200 $\mu$pm. In turn, a dry-film photoresist having a thickness of 30 $\mu$m to 50 $\mu$m is pressed onto the surface of the rib material layer 291 at a temperature of 80 fl C. to 100 fl by means of a laminator. A cutting mask 61 having a masking pattern corresponding to the barrier ribs 29 is formed by pattern exposure and development (FIG. 3A). The rib width W is about 50 $\mu$m to about 100 $\mu$m and the inter-rib spacing D is about 50 $\mu$m to about 150 $\mu$m.

Figure 3B:
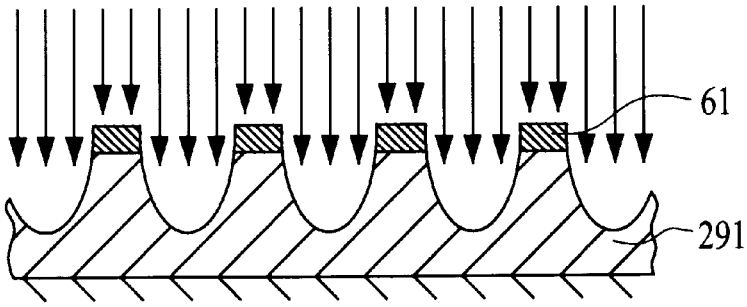
Figure 3C:
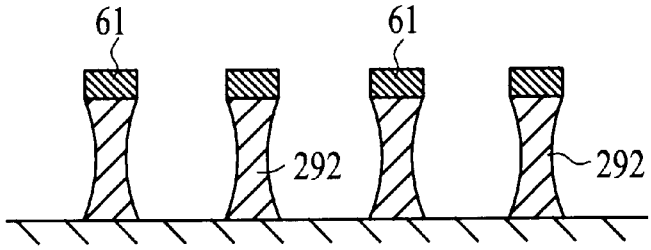
Figure 3D:
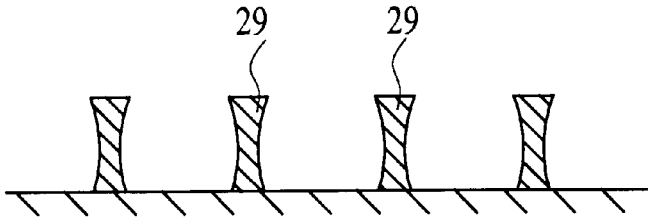

Subsequently, the rib material layer 291 is partially removed by way of a sand blast method (FIGS. 3B and 3C). The sand blast method employs, for example, glass particles having particle diameters of about 10 $\mu$m to about 30 $\mu$m as a cutting medium, dry air or nitrogen gas as a blast medium, and a jet pressure of 1.0 to 3 kg/cm$^2$. A cutting operation is performed on the entire display surface of the substrate 21 by way of relative movement of a jet nozzle with respect to the glass substrate 21 in a parallel relation. After the completion of the removal by way of the sand blast, the cutting mask 61 is chemically removed. The removal of the cutting mask is achieved by spraying a sodium hydroxide solution. Then, the patterned rib material layer 292 is annealed to provide the barrier ribs 29 (FIG. 3D).

Figure 4A:
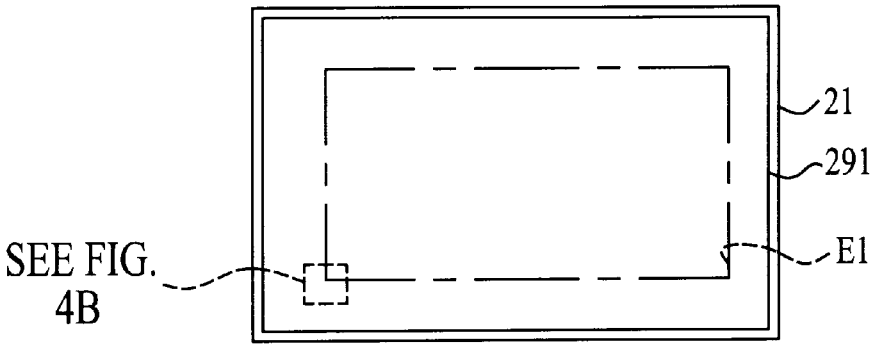
FIG. 4 is a diagram illustrating a masking pattern according to afirst embodiment of the present invention.
Figure 4B:
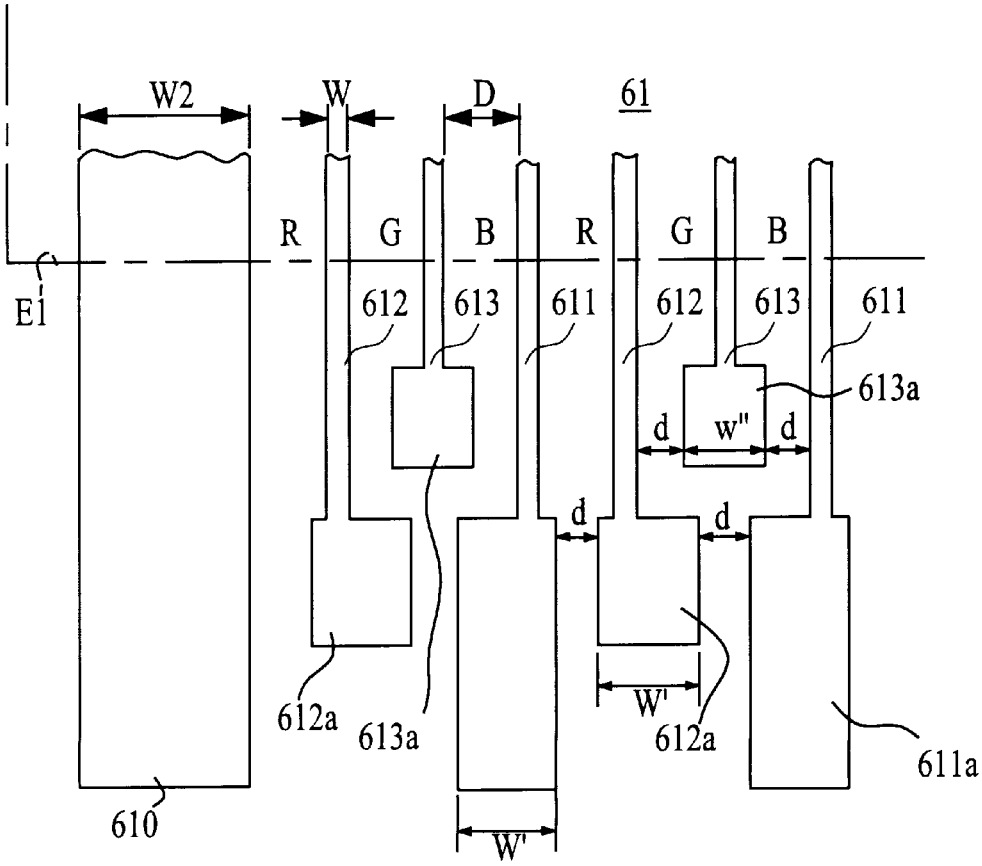
Figure 5:
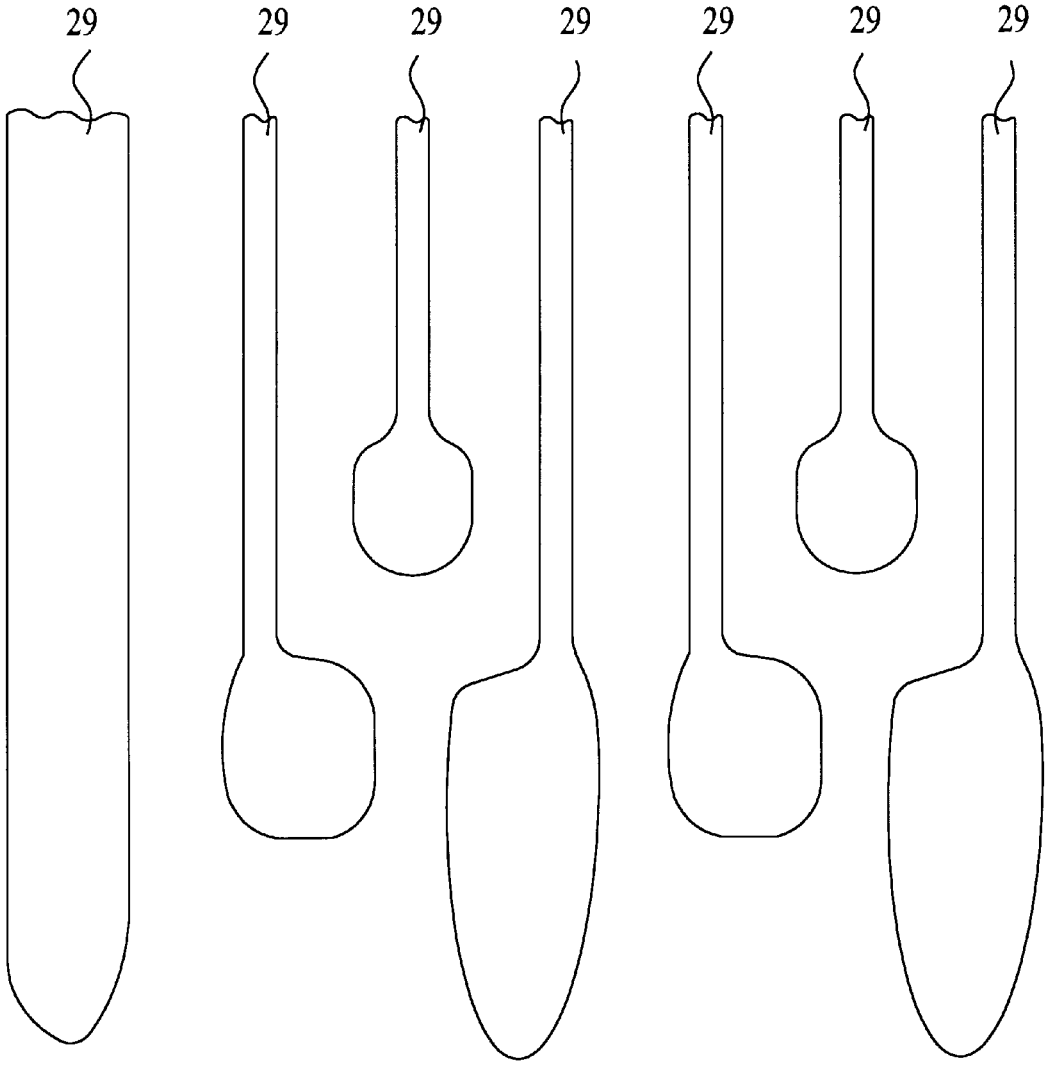
FIG. 5 is a plan view illustrating a rib configuration corresponding to the masking pattern of FIG. 4.

FIG. 4 is a diagram illustrating a masking pattern according to a first embodiment of the present invention, and FIG. 5 is a plan view illustrating a rib configuration corresponding to the masking pattern of FIG. 4.

The masking pattern (overall plan configuration of the cutting mask 61) according to this embodiment is a stripe pattern having a plurality of elongate portions 610, 611, 612 and 613 corresponding to the respective barrier ribs 29. The elongate portions 610 of the masking pattern, corresponding to ribs to be provided on opposite sides of rib arrangement each have a constant width W2 along the overall length thereof (only one elongate portion 610 on one side is shown in FIG. 4). The width W2 is significantly larger (e.g., five times larger) than a rib width W to prevent the peel-off of the mask which may otherwise occur due to excessive side-cut along the rib arrangement (or along the width of the elongate portion). The other elongate portions 611 to 613 respectively have end portions 611*a*, 612*a* and 613*a* at the opposite ends thereof (only end portions on one side are shown in FIG. 4), which each laterally project with respect to the other portion thereof. That is, the end portions are herein regarded as enlarged portions.

Portions of the elongate portions 611 to 613 present outside the display area E1 have different lengths (the lengths of the elongate portions 611, 612 and 613 increase in this order). The end portion 613*a* of the shortest elongate portion 613 is offset to the side of the display area E1 with respect to the end portions 611*a* and 612*a* of the other elongate portions 611 and 612. The end portion 611*a* of the elongate portion 611 has a greater length than the end portion 612*a* of the elongate portion 612, and the elongate portion 611 has a greater length than the elongate portion 612 by a length difference between the end portions 611*a* and 612*a*. The end portions 611*a* and 612*a* each have a width W' such that a spacing d therebetween is smaller than an inter-rib spacing D, i.e., a spacing between adjacent elongate portions within the display area E1 (d<D). The end portion 613*a* has a width W" such that the elongate portions 611 and 612 adjacent thereto are respectively spaced therefrom by a distance substantially equivalent to the spacing d. That is, the spacings between the elongate portions 611, 612 and 613 are locally reduced around the opposite ends thereof. It should be noted that the widths W' and W" are, of course, greater than the rib width W.

By thus allowing the elongate portions 611 to 613 to have enlarged end portions, the longitudinal side-cut of the barrier ribs can be reduced. Since the cutting rate is reduced with reduction in the inter-rib spacing D as shown in FIG. 15, the removal of the rib material around the ends of the elongate portions 611 to 613 is delayed in comparison with the other portions thereof by increasing the widths W' and W" to reduce the spacing d. Further, the enlargement of the end portions increases the time required for the widthwise side-cut amount sc2 to reach the width W' and W". The synergism of these effects suppresses the longitudinal extension of ribmaterial lost portions below the elongate portions 611 to 613, thereby preventing the peel-off of the mask during the cutting operation. Further, the elongate portions 611 to 613 each have a large bond area at opposite ends thereof for bonding to the rib material layer. The large bond area also contributes to the prevention of the peel-off of the mask.

The barrier ribs 29 formed by using the cutting mask 61 have different lengths because of differences in the length between the elongate portions 611 to 613. The difference in the rib length can be utilized as rib identification information. When the state of R-fluorescent layers are to be checked after the formation of the fluorescent layers of the three colors, for example, barrier ribs having the greatest length of the three (barrier ribs corresponding to the elongate portions 610 and 611 in FIG. 4) can be used as an indicator for locating the R-fluorescent layers.

Figure 6:
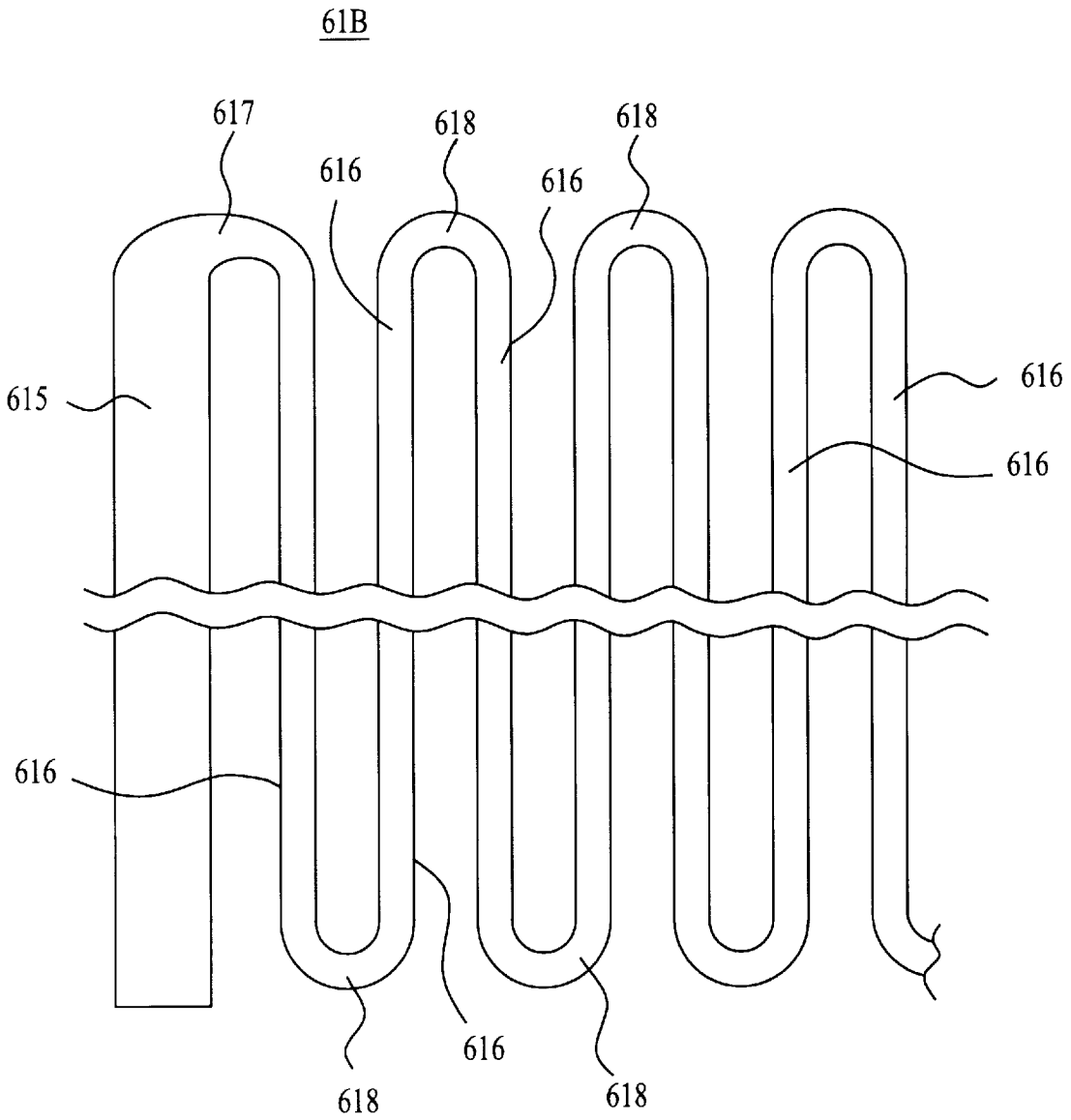
FIG. 6 is a diagram illustrating a masking pattern according to a second embodiment of the present invention.
Figure 7C:
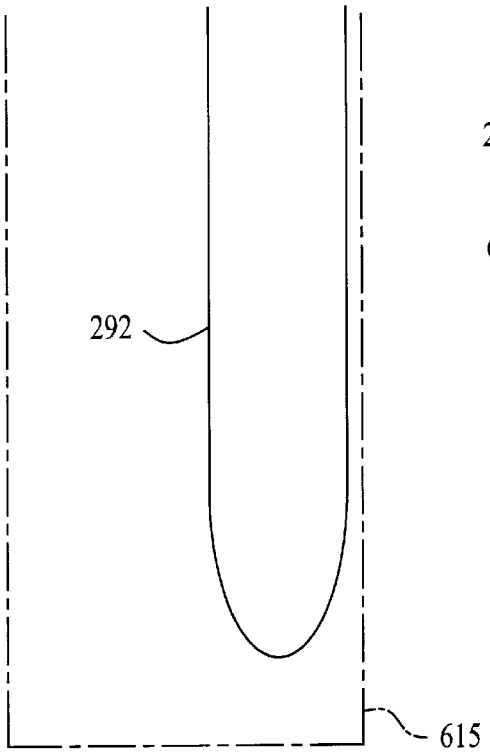
FIGS. 7A, 7B and 7C are diagrams for explaining advantages of the masking pattern shown in FIG. 6.
Figure 7A:
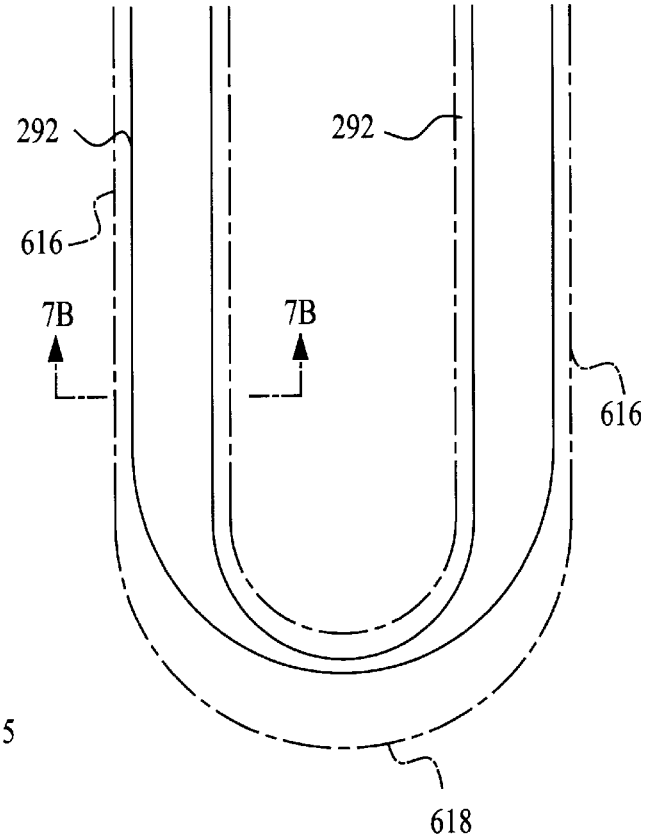
Figure 7B:
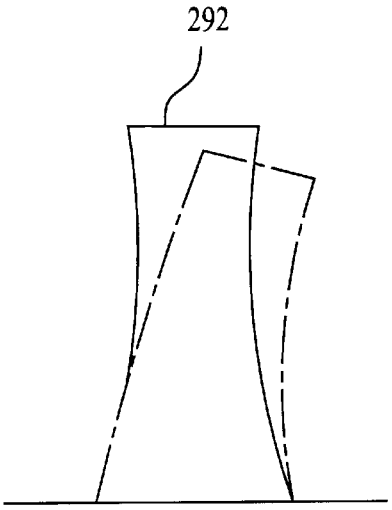

FIG. 6 is a diagram illustrating a masking pattern according to a second embodiment of the present invention, and FIGS. 7A, 7B and 7C are diagrams for explaining advantages of the masking pattern shown in FIG. 6. FIG. 7B is a sectional view taken along a line 7B—7B in FIG. 7A.

The masking pattern shown in FIG. 6 is a meander pattern including a plurality of elongate portions 615 and 616 corresponding to the respective barrier ribs 29 and arcuate portions 618 each interconnecting end portions of adjacent elongate portions. The elongate portions 615 corresponding to ribs to be provided on opposite sides of rib arrangement each have a greater width than the other elongate portions 616. The arcuate portions 618 each span between adjacent elongate portions 616, and project from the elongate portions 616 along the rib arrangement. Like the masking pattern shown in FIG. 4, the longitudinal side-cut of the barrier ribs can be suppressed, thereby preventing the peel-off of the mask.

Since rows of a display matrix formed by using the meander pattern each have an open end on either side thereof unlike a display matrix formed by using a ladder pattern in which adjacent elongate portions 615 and 616 are interconnected at both ends thereof, the rows in the discharge space 30 are not perfectly isolated from each other. More specifically, the use of the meander pattern does not obstruct an evacuation process in the fabrication of the PDP 1.

The interconnections between the elongate portions 615 and 616 do not have a linear configuration but an arcuate configuration (including an elliptically arcuate configuration) projecting outside. Therefore, even if the rib material layer 292 is left unremoved below the arcuate portions 618 at the end of the cutting process as shown in FIG. 7A, the barrier ribs are less liable to deform during the subsequent annealing process. In general, an object having an asymmetrical configuration suffers from local contraction, when annealed. Therefore, the barrier ribs 292 are liable to incline as indicated by a dashed line in FIG. 7B. In this embodiment, however, the arcuate portions (interconnections) of the meander pattern allow unnecessary rib portions of the rib material layer 292 to be gently curved from straight rib portions, so that the influence of the local contraction can be alleviated to reduce the inclination of the barrier ribs.

Figure 8:
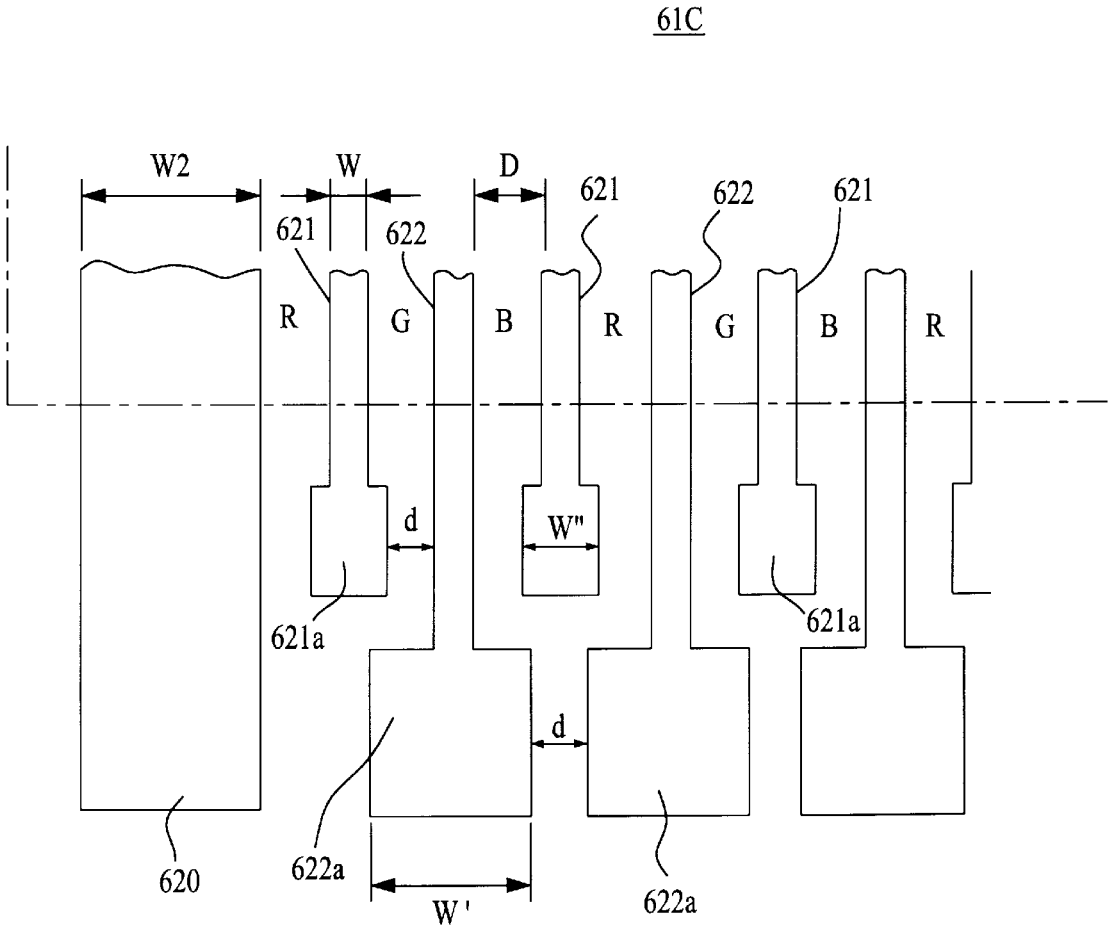
FIG. 8 is a diagram illustrating a masking pattern according to a third embodiment of the present invention.
Figure 9:
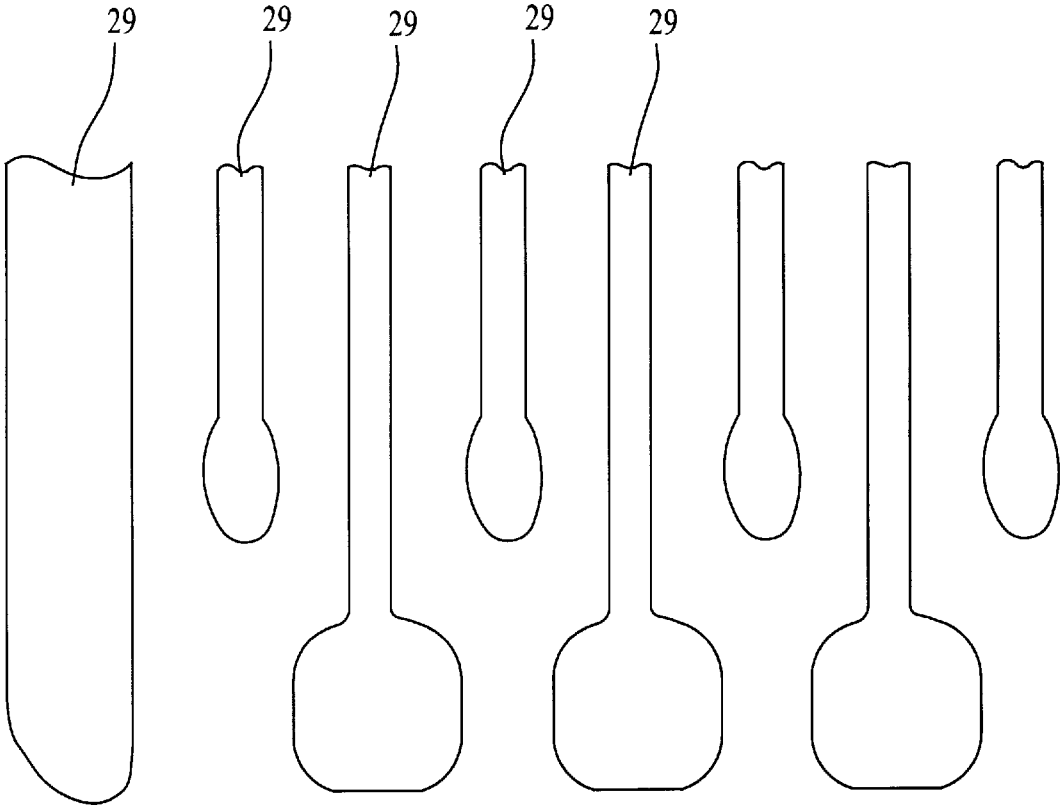
FIG. 9 is plan view illustrating a rib configuration corresponding to the masking pattern of FIG. 8.

FIG. 8 is a diagram illustrating a masking pattern according to a third embodiment of the present invention, and FIG. 9 is a plan view illustrating a rib configuration corresponding to the masking pattern of FIG. 8.

The masking pattern (overall plan configuration of a cutting mask 61C) shown in FIG. 8 is a stripe pattern having a plurality of elongate portions 620, 621 and 622 corresponding to the respective barrier ribs 29. Like the masking pattern shown in FIG. 4, the elongate portions 620 corresponding to ribs to be provided on opposite sides of rib arrangement each have a constant width W2 (W2>>W) along the overall length thereof. The other elongate portions 621 and 622 have enlarged end portions 621*a* and 622*a*, respectively. On one longitudinal side of the elongated portions, a portion of the elongate portion 621 present outside the display area E1 has a smaller length than that of the elongate portion 622, and the end portion 621*a* of the elongate portion 621 is offset to the side of the display area E1 with respect to the end portion 622*a* of the elongate portion 622. On the other longitudinal side (not shown) of the elongate portions, a portion of the elongate portion 621 present outside the display area E1 has either a smaller length or a greater length than that of the elongate portion 622.

The end portion 622*a* has a width W' such that a spacing d between adjacent end portions 622*a* is smaller than an inter-rib spacing D (or a spacing between middle portions of the elongate portions) within the display area E1. The end portion 621*a* has a width W" such that a spacing between the end portion 621*a* and a middle portion of the elongate portion 622 is substantially equivalent to the spacing d.

In the third embodiment shown in FIG. 8, the removal of the rib material around the ends of the elongate portions 621 and 622 are delayed in comparison with the other portions thereof, like the first embodiment shown in FIG. 4. Therefore, the longitudinal extension of rib-material lost portions below the elongate portions 621 and 622 is suppressed, thereby preventing the peel-off of the mask during the cutting operation.

Figure 10:
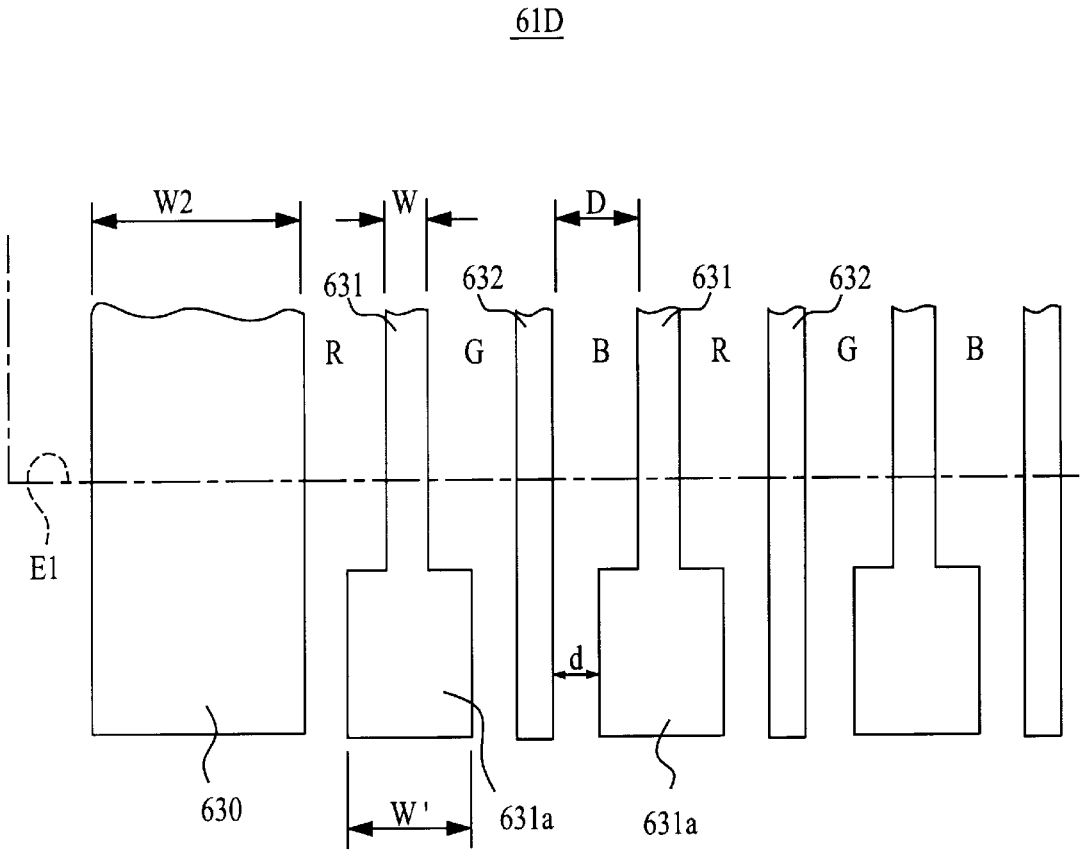
FIG. 10 is a diagram illustrating a masking pattern according to a fourth embodiment of the present invention.
Figure 11:
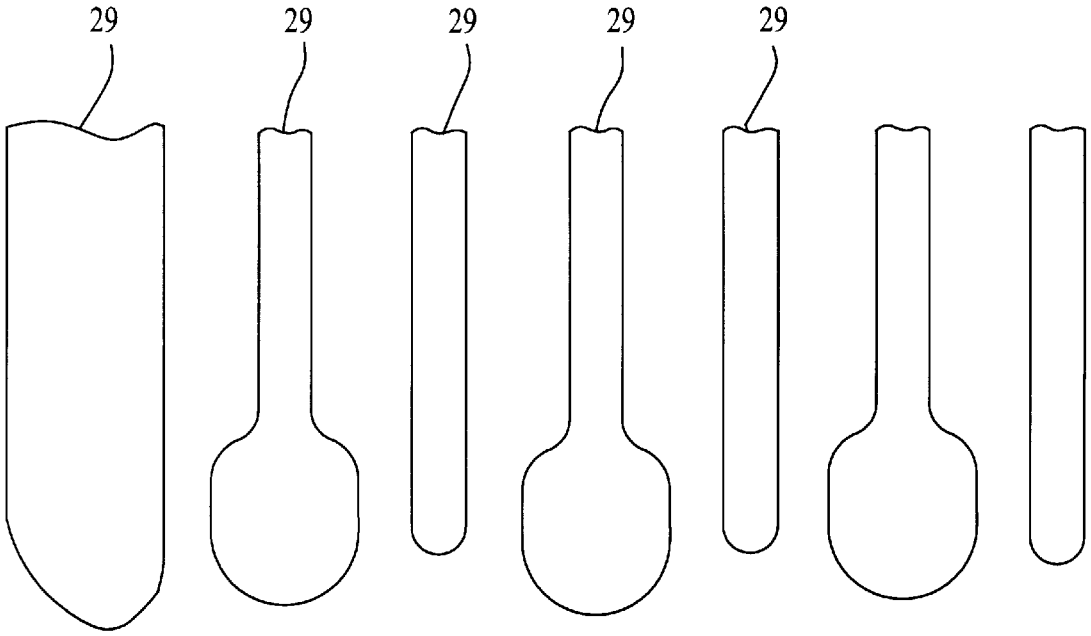
FIG. 11 is a plan view illustrating a rib configuration corresponding to the masking pattern of FIG. 10.

FIG. 10 is a diagram illustrating a masking pattern according to a fourth embodiment of the present invention, and FIG. 11 is a plan view illustrating a rib configuration corresponding to the masking pattern of FIG. 10.

The masking pattern (overall plan configuration of the cutting mask 61D) shown in FIG. 10 is a stripe pattern having a plurality of elongate portions 630, 631 and 632 corresponding to the respective barrier ribs 29. The elongate portions 630 corresponding to ribs to be provided on opposite sides of rib arrangement each have a width W2 significantly greater than the rib width W. The elongate portions 631 and 632 are alternately arranged, and the elongate portions 631 each have an enlarged end portion 631*a*. The elongate portions 632 each have a constant width (rib width W). The end portion 631*a* has a width W' (W'>W) such that a spacing d between the end portion 631*a* and an adjacent elongate portion 632 is smaller than an inter-rib spacing D.

In the fourth embodiment shown in FIG. 10, the removal of the rib material around the ends of the elongate portions 631 and 632 is delayed in comparison with the other portions thereof, like the first and third embodiments shown in FIGS. 4 and 8. Therefore, the longitudinal extension of rib-material lost portions below the elongate portions 631 and 632 is suppressed, thereby preventing the peel-off of the mask during the cutting operation. Further, a difference in the configuration between the elongate portions 631 and 632 can be utilized as rib identification information. In comparison with the first and third embodiments shown in FIGS. 4 and 8 which utilize the length difference as the rib identification information, the portions of the barrier ribs present outside the display area E1 each have a reduced length in the fourth embodiment shown in FIG. 10. Therefore, this arrangement is advantageous for reduction of the non-display area E2 (see FIG. 2).

Figure 12:
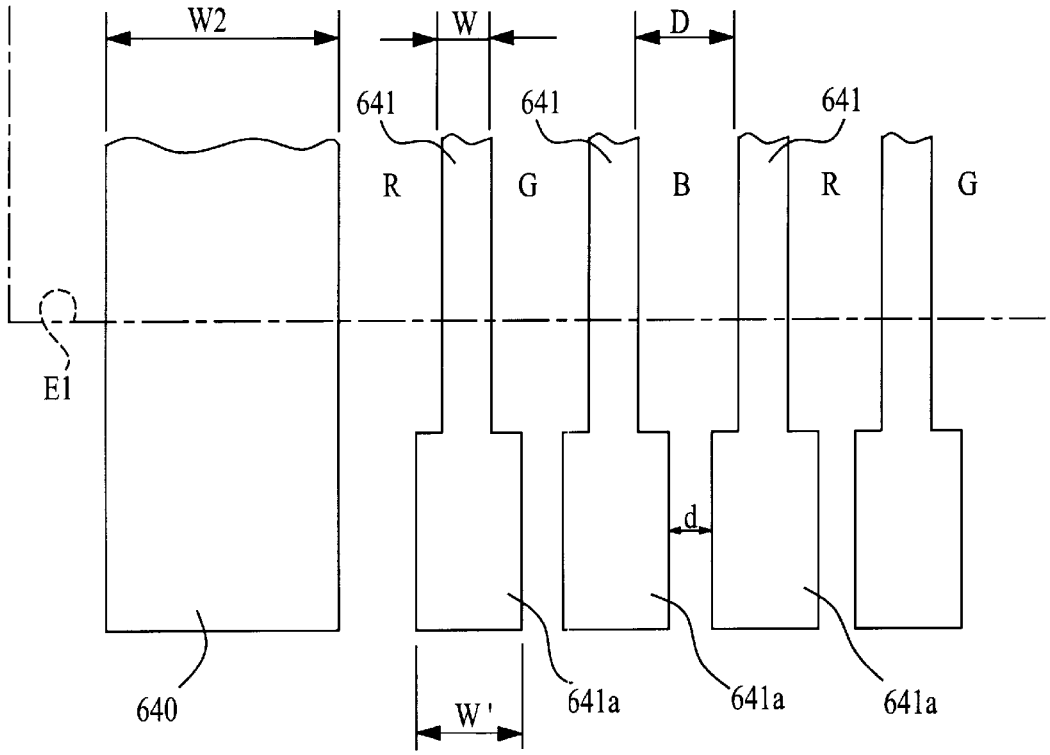
FIG. 12 is a diagram illustrating a masking pattern according to a fifth embodiment of the present invention.
Figure 13:
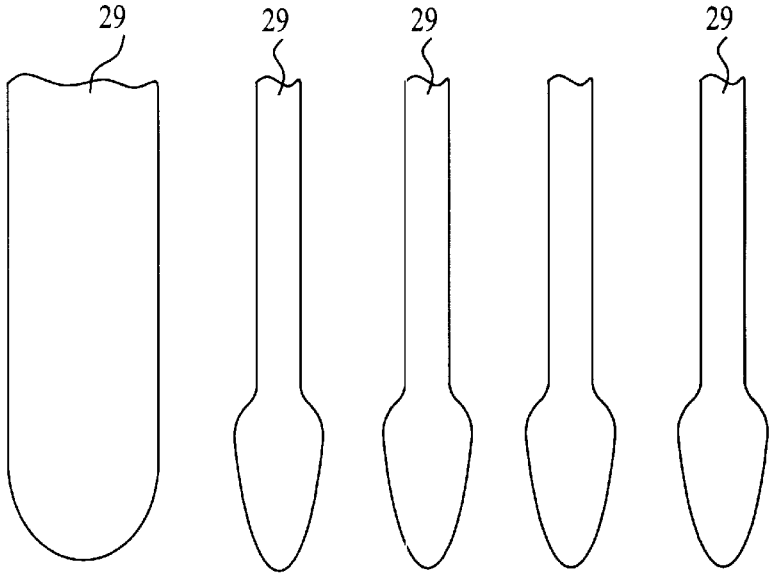
FIG. 13 is a plan view illustrating a rib configuration corresponding to the masking pattern of FIG. 12.

FIG. 12 is a diagram illustrating a masking pattern according to a fifth embodiment of the present invention, and FIG. 13 is a plan view illustrating a rib configuration corresponding to the masking pattern of FIG. 12.

The masking pattern (overall plan configuration of the cutting mask 61D) shown in FIG. 12 is a stripe pattern having a plurality of elongate portions 640 and 641 corresponding to the respective barrier ribs 29. The elongate portions 641 corresponding to ribs to be provided on opposite sides of rib arrangement each have a linear configuration having a constant width W2 significantly greater than the rib width W. The other elongate portions 641 each have an enlarged end portion 641*a*. The end portion 641*a* has a predetermined width W' (W'>W) such that a spacing d between adjacent end portions 641*a* is smaller than the inter-rib width D. In the fifth embodiment shown in FIG. 12, the removal of the rib material around the ends of the elongate portions 641 is delayed in comparison with the other portions thereof, like the foregoing embodiments. Therefore, the peel-off of the mask during the cutting operation can be prevented.

Although the embodiments described above employ the sand blast method for the removal of the rib material, the present invention can be applied to a case where the removal of the rib material is achieved by a hydro-honing method. An additional masking pattern for prevention of the patterning defect may be used along with the masking pattern having locally enlarged portions and corresponding to the barrier ribs necessary for the display, if the use of such an additional masking pattern is allowable in consideration of the construction of a display panel and a fabrication process therefor. The configuration, dimensions and arrangement of the end portions of the elongate portions may be changed as required.

After the barrier ribs are formed by using any of the masking patterns of the aforementioned embodiments, the fluorescent layers 28R, 28G and 28B of the three colors are applied between the barrier ribs. Thus, a rear plate is completed.

On the other hand, the sustain electrodes X and Y are formed on the interior surface of the glass substrate 11, and then covered with the dielectric layer 17. Thereafter, a sealing material is applied on a peripheral area of the glass substrate 11, and the protection film 18 is formed on the surface of the dielectric layer by vapor deposition. Thus, a front plate is completed.

In turn, the rear plate and the front plate are bonded together for sealing, and a gas for electric discharge is filled into the inside of a thus formed panel. Thus, the PDP 1 shown in FIG. 1 is completed.

While the present invention has been described by way of specific embodiments thereof, it should be understood that these embodiments are not limitative of the present invention and various modifications and changes may be made thereto without departing from the spirit and scope of the present invention, as defined in the appended claims.

What is claimed is:

1. A method for forming a plurality of barrier ribs each having an elongate configuration in plan and extending in the same direction for fabrication of a display panel, comprising the steps of:

forming a mask for cutting having a masking pattern corresponding to the plurality of barrier ribs on a rib material layer; and removing portions of the rib material layer by jetting a cutting medium thereto, wherein the masking pattern is a stripe pattern which includes the plurality of elongate portions corresponding to the respective barrier ribs and is configured such that the end portions of the respective elongate portions each have a greater width than the other portion thereof and are arranged in a staggered manner.

2. The method of claim 1, wherein the end portions of the respective elongate portions have at least two different lengths.

3. A method as set forth in claim 1, wherein the masking pattern is a stripe pattern which includes the plurality of elongate portions corresponding to the respective barrier ribs and is configured such that the end potions of the respective elongate portions each have a greater width than the other portion thereof.

4. A method as set forth in claim 1, wherein the masking pattern is a meander pattern which includes the plurality of elongate portions corresponding to the respective barrier ribs and arcuate portions interconnecting each adjacent pair of elongate portions at ends thereof.

5. A method as set forth in claim 1, wherein elongate portions corresponding to end barrier ribs located on opposite sides of the p1urality of barrier ribs have a greater width than the other elongate portions.

6. A method for forming a plurality of barrier ribs each having an elongate configuration in plan and extending in the same direction for fabrication of a display panel, comprising the steps of:

forming a mask for cutting having a masking pattern corresponding to the plurality of barrier ribs on a rib material layer; and removing portions of the rib material layer by jetting a cutting medium thereto, wherein the masking pattern is a stripe pattern which includes the plurality of elongate portions corresponding to the respective barrier ribs and is configured such that the end portions of the respective elongate portions each have a greater width than the other portion thereof and are arranged in a staggered manner, and elongate portions corresponding to end barrier ribs located on opposite sides of the plurality of barrier rib each have a greater width than the other elongate portions.

7. A method of forming a plurality of barrier ribs each having an elongate configuration in plan and extending in the same direction within a display area for fabrication of a display panel, comprising the steps of:

forming a mask for cutting having a masking pattern corresponding to the plurality of barrier ribs on a rib material layer; and removing portions of the rib material layer by jetting a cutting medium thereto, wherein the masking pattern is configured such that a plurality of elongate portions corresponding to the respective barrier ribs each extend across the display area to the outside of the display area and a spacing between adjacent end portions of elongate portions is smaller than a spacing between adjacent elongate portions within the display area, and elongate portions corresponding to end barrier ribs located on opposite sides of the plurality of the barrier ribs each have a greater width than the other elongate portions.

8. A method of forming a plurality of barrier ribs each having an elongate configuration in plan and extending in the same direction within a display area for fabrication of a display panel, comprising the steps of:

forming a mask for cutting having a masking pattern corresponding to the plurality of barrier ribs on a rib material layer; and removing portions of the rib material layer by jetting a cutting medium thereto, wherein the masking pattern is configured such that a plurality of elongate portions corresponding to the respective barrier ribs each extend across the display area to the outside of the display area and a spacing between adjacent end portions of elongate portions is smaller than a spacing between adjacent elongate portions within the display area, and alternate first elongate portions have an enlarged end portion and are separated by alternate second elongate portions having a constant width.

* * * * *